US006723412B2

(12) United States Patent
Prévost

(10) Patent No.: US 6,723,412 B2
(45) **Date of Patent: *Apr. 20, 2004**

(54) SYNTHETIC TURF

(75) Inventor: Jean Prévost, Westmount (CA)

(73) Assignee: Fieldturf, Inc., Montreal (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/988,783

(22) Filed: Nov. 20, 2001

(65) Prior Publication Data

US 2002/0028307 A1 Mar. 7, 2002

Related U.S. Application Data

(62) Division of application No. 08/947,881, filed on Oct. 9, 1997, now Pat. No. 6,338,885.

(30) Foreign Application Priority Data

Mar. 10, 1997 (CA) ..... 2199595

(51) Int. Cl.[7] ..... D05C 17/02

(52) U.S. Cl. ..... 428/87; 428/17; 428/95; 428/327; 428/143; 428/167; 428/220; 428/317.9; 428/332; 428/402

(58) Field of Search ..... 428/15, 17, 85, 428/87, 95, 323, 327, 143, 402, 156, 167, 195, 220, 304.4, 317.9, 332

(56) References Cited

U.S. PATENT DOCUMENTS

| | | | | |
|---|---|---|---|---|
| 3,418,897 | A | | 12/1968 | Humalainen |
| 3,433,137 | A | | 3/1969 | Henderson |
| 3,467,391 | A | | 9/1969 | Elesh |
| 3,573,147 | A | | 3/1971 | Elbert |
| 3,940,522 | A | | 2/1976 | Wessells |
| 3,995,079 | A | | 11/1976 | Haas, Jr. |
| 4,007,307 | A | | 2/1977 | Friedrich |
| 4,044,179 | A | | 8/1977 | Haas, Jr. |
| 4,217,383 | A | | 8/1980 | Patterson et al. |
| 4,336,286 | A | | 6/1982 | Tomarin |
| 4,337,283 | A | | 6/1982 | Haas, Jr. |
| 4,389,434 | A | | 6/1983 | Polman |
| 4,389,435 | A | | 6/1983 | Haas, Jr. |
| 4,396,653 | A | | 8/1983 | Tomarin |
| 4,426,415 | A | | 1/1984 | Avery |
| 4,497,853 | A | | 2/1985 | Tomarin |
| 4,497,854 | A | | 2/1985 | Milner et al. |
| 4,637,942 | A | * | 1/1987 | Tomarin |
| 4,735,825 | A | | 4/1988 | Friedrich |
| 4,755,401 | A | | 7/1988 | Friedrich et al. |
| 5,041,320 | A | | 8/1991 | Meredith et al. |
| 5,205,562 | A | | 4/1993 | Hammon |
| 5,443,870 | A | | 8/1995 | Lurie et al. |
| 5,601,886 | A | | 2/1997 | Ishikawa et al. |
| 5,678,951 | A | | 10/1997 | Levasseur |
| 5,794,861 | A | | 8/1998 | Rutherford, Sr. |
| 6,048,282 | A | | 4/2000 | Prevost et al. |
| 6,338,885 | B1 | * | 1/2002 | Prevost |

FOREIGN PATENT DOCUMENTS

| | | | |
|---|---|---|---|
| CA | 1182484 | * | 2/1985 |
| CA | 2095158 | | 10/1994 |
| DE | 2638875 | | 3/1978 |
| DE | 3409361 A1 | | 9/1985 |
| DE | 3631800 A1 | | 4/1987 |
| DE | 8807142 | | 10/1988 |
| EP | 0383691 B1 | | 5/1993 |

* cited by examiner

*Primary Examiner*—Deborah Jones
*Assistant Examiner*—Wendy Boss
(74) *Attorney, Agent, or Firm*—Birch, Stewart, Kolasch & Birch, LLP

(57) ABSTRACT

A synthetic grass surface comprising widely spaced rows of ribbons and the ribbons having a length about twice as long as the spacing between the rows of ribbons. A particulate material is laid on a matrix of the synthetic grass, and the thickness of the particulate material is as least two-thirds the length of the ribbons.

28 Claims, 4 Drawing Sheets

SYNTHETIC TURF

CROSS-REFERENCE TO RELATED APPLICATION

This application is a divisional application of U.S. Ser. No. 08/947,881, filed Oct. 9, 1997 now U.S. Pat. No. 6,338,885.

BACKGROUND OF THE INVENTION

1. Field of the Invention

This invention is directed toward improved synthetic grass surfaces. The invention is more particularly directed toward improved, synthetic grass sports surfaces. The invention is also directed toward a method of making an improved synthetic grass sports surface, and an apparatus for carrying out the method. The invention is further directed toward an improved synthetic grass sports surface having playing lines formed in its top surface and to a method of making the lined surface.

2. Description of the Prior Art

Synthetic grass sports surfaces are well known. They are used to replace natural grass surfaces which do not stand up well to wear and which require a great deal of maintenance. Also, natural grass surfaces do not grow well in partly or fully enclosed sports stadiums. The synthetic grass surfaces stand up to wear much better than the natural grass surfaces, do not require as much maintenance, and can be used in closed stadiums. Some synthetic grass surfaces comprise rows of strips or ribbons of synthetic material, extending vertically from a backing mat with particulate material infilled in between the ribbons on the mat. The ribbons of synthetic material usually extend a short distance above the layer of particulate material and represent blades of grass. The particulate material usually comprises sand, as shown by way of example in U.S. Pat. Nos. 3,995,079, 1976, Haas, Jr. and 4,389,435, 1983, Haas, Jr., but can comprise other materials or a mixture of sand and other materials, as shown in U.S. Pat. No. 4,337,283, 1982, Haas, Jr., by way of example. The particulate material provides resiliency to the synthetic grass surfaces, and the surfaces are often laid on a resilient pad to provide further resiliency to the surfaces.

The known sand-filled synthetic grass sports surfaces have some disadvantages. The surfaces usually become hard after extended use because the sand, between the rows of ribbons, becomes compacted. Compacting occurs, in part, because the rows of ribbons are quite close together, and the sand cannot spread a great deal laterally during use. Compacting also occurs, in part, because the close spacing of the ribbon rows traps debris, worn and torn off the ribbons, in the sand, even when the particulate material comprises rounded sand particles. With an increase in compaction, the surface becomes progressively harder and less resilient. The performance of the surface is shortened, and it has lessened playing qualities. The surfaces also become harder after use because the resilient pads, if used, slowly collapse under use, becoming denser. Removal and replacement of the compacted particulate material, or even loosening of it, is difficult because of the close spacing of the rows of ribbons. It can require expensive equipment to remove and replace the compacted particulate material, or even loosen it, and this adds to the cost of maintaining the surface.

Another problem with the known synthetic grass sport surfaces is the problem of drainage. Water flow through the surfaces has generally been slow. The ribbons are usually attached to the mat by tufting them through the mat, and then the bottom of the mat is coated with a bonding layer to bond the ends of the ribbons to the mat. The bonding layer is non-porous. To provide adequate porosity, the coated mat is punctured to provide holes. However, the particulate material often flows into these holes, plugging them up and thus reducing the drainage qualities of the surface. The loss of the particulate material into and through the holes also requires that it be replaced on top of the mat, adding to the cost of maintaining these surfaces. Compaction of the surface also inhibits drainage.

The known synthetic surfaces also have relatively poor playing qualities. When infilled with rounded sand particles more rounded than angular, because the rounded particles are thought to compact less and cause less abrasion, the surface can become too slippery, particularly when the ribbons are only slightly longer than the thickness of the layer of particulate material. Also, the closely spaced fine ribbons, if penetrated, can tightly grip the cleats and do not tear as easily as grass, thus making release of the cleats more difficult and making playing on the surface more difficult and dangerous than when playing on grass. If a player's cleats do not release easily, he could injure his leg, ankle, or knee. It has also been found that if the athlete's cleat penetrates a seam area, the chances of the shoe not being released or allowed to pivot is much greater.

The known synthetic surfaces, with closely spaced rows of ribbons, also increase the speed of a rolling ball from the speed with which it rolls on natural grass. The closely spaced ribbons create an almost solid, low resistance surface for a rolling ball, thus adversely affecting the playing qualities of the surface. If the surfaces are employed with a resilient base pad, balls bounce more on the surfaces than on grass, subtly changing the nature of the game. The low resistance surface also makes it more slippery for tennis players.

The known surfaces have other disadvantages. Usually the ribbons employed are quite narrow, and they can curl creating an appearance unlike grass. The narrow ribbons also abrade easier, creating debris that can increase compaction of the surface. The close spacing of the ribbon rows also causes skin abrasion on players falling or sliding on the surfaces.

SUMMARY OF THE INVENTION

It is the purpose of the present invention to provide an improved synthetic grass sports surface that is more resilient, and remains more resilient for a longer period of time, than known synthetic grass surfaces.

It is another purpose of the present invention to provide improved synthetic grass sports surfaces that have improved drainage properties and improved playing properties.

It is yet another purpose of the present invention to provide improved synthetic playing surfaces that are relatively less expensive to manufacture, to install, and particularly to maintain.

It is still another purpose of the present invention to provide synthetic playing surfaces that are less abrasive, easier to mark with lines, and easier to seam.

It is another purpose of the present invention to provide a method for making one embodiment of the present invention having improved drainage properties and a machine for carrying out the method.

In accordance with the present invention, it has been found that an improved synthetic grass surface can be provided by employing relatively widely spaced rows of ribbons. The wider spacing of the ribbon rows reduces the compaction of the infill that normally occurs with more closely spaced rows, thus extending the life of the surface with respect to resiliency. Reduced compaction also ensures better drainage. Wider row spacing should also ensure less wear and abrasion of the ribbons, extending the life of the surface and minimizing the formation of ribbon debris which affects compaction and drainage. Wider row spacing also allows better cleat penetration and allows the cleats to release easier, thus improving the playing qualities and reducing the risk of injury. Wider ribbon row spacing can also cause balls on the surface to roll more like they roll on grass, thus improving playing qualities. Wider ribbon row spacing also makes it easier to loosen the particulate material if it does start to compact, and to clean or replace it. Wider ribbon row spacing also reduces abrasion to the players when contacting the surface. Wider ribbon row spacing can make it easier to seam the surface.

In accordance with the present invention, it has also been found that an improved synthetic grass surface can be provided by providing ribbons having a length about twice as long as the spacing between the rows of ribbons. The present invention employs ribbons that are quite long compared to the ribbons now employed. The longer ribbons allow a thicker layer of particulate material to be used which can eliminate the need for a resilient pad and make installation of the surface simpler and cheaper. A thicker layer of particulate material or infill promotes better drainage because of the higher water head created by water on the synthetic grass. Preferably, the layer of particulate material has a thickness at least two-thirds the length of the ribbons. The longer ribbons can also provide more ribbon material above the infill for certain sport surfaces, creating a more realistic grass-like surface that, in combination with the wider spacing of the ribbon rows, allows a player's cleats to both penetrate the surface for traction but also easily release. The player's cleats can move the ribbons and infill material sideways to allow easier release.

In accordance with another embodiment of the present invention, the improved synthetic grass surface is constructed to have improved drainage qualities provided by the manner and pattern in which the ribbons are attached. In accordance with the present invention, the rows of ribbons are attached by strips of bonding material applied to the back of the mat. The strips of bonding material are spaced apart and leave areas of the mat uncoated. Since the mat in this embodiment is porous, the uncoated areas provide for excellent drainage. Providing a surface with a relatively large spacing between the rows of ribbons allows strips of bonding material to be provided with relatively wide porous areas of mat between them. The invention is also directed to an apparatus to simply and easily apply the bonding strips to the backing.

Improved drainage properties are also obtained by having at least one of the backing layers, a needle punched fabric, provided with fuzzy fibers on one or both surfaces. The fuzzy fibers improve the drainage qualities of the backing layer, and thus of the surface, since the fuzzy fiber ends wick away the moisture.

Also in accordance with the present invention, the surface is provided with an improved infill layer of particulate material. The infill preferably comprises a mixture of silica sand and cryogenically ground rubber particles. The cryogenically ground rubber particles wet more easily than non-cryogenically ground rubber particles and thus allow faster drainage. The ratio of sand to rubber can be varied depending on the end use of the surface; the more resilient surface required, the more rubber employed. The cryogenically ground rubber is less angular than non-cryogenically ground rubber and has less tendency to allow water, and microscopic air bubbles carried by the water, to attach to it. Thus, there is less tendency for the rubber particles to float upwardly when the surface is flooded which could result in the loss of material and a change in the playing qualities of the surface.

The surface, in accordance with the present invention, is also provided with line forming means, the lines being used to mark the playing surface for the sport being played. Examples of such lines are the yardage lines used in the game of football which traverse the field at regular intervals. These lines are usually laid down on top of the field with chalk or other similar marking material. In accordance with the present invention, the surface can be provided with permanent lines seamed in the surface. The lines are seamed by the manner in which the backing layers are joined together.

The invention is particularly directed toward a synthetic grass surface having a flexible, backing layer and parallel rows of synthetic ribbons representing blades of grass projecting vertically from the backing layer, the rows of ribbons spaced from each other from between five-eighths and two and one-quarter inches apart. The surface includes a relatively thick layer of particulate material on the backing layer between the ribbons and supporting them in a relatively upright position relative to the backing layer.

The invention is further particularly directed toward a synthetic grass surface having a flexible, backing layer and parallel rows of synthetic ribbons representing blades of grass projecting upwardly from the backing layer. The surface includes a relatively thick layer of particulate material on the backing layer supporting the ribbons in a relatively upright position relative to the backing layer, the particulate material comprising a mixture of cryogenically ground rubber and silica sand.

Cryogenically ground rubber means rubber particles which have been made from the process of reducing rubber from used tires by a cryogenically ground rubber method. The fragmenting of the rubber when it is frozen results in rubber particles with smoother surfaces less jagged as would occur with non-cryogenically ground rubber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
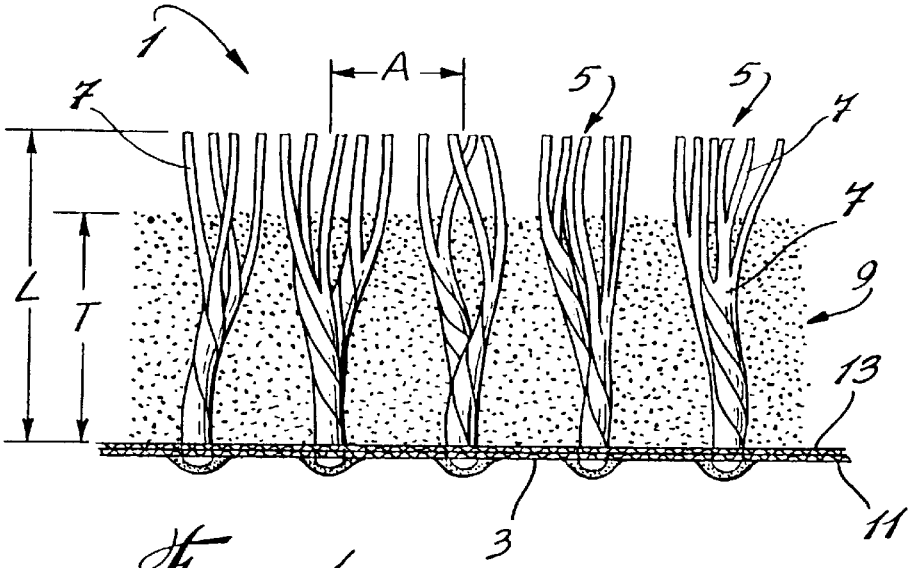
FIG. 1 is a cross-section view of a surface of the present invention.

The synthetic grass surface 1 of the present invention, as shown in FIG. 1, has a thin, flexible, backing member 3 with parallel rows 5 of strips or ribbons 7 projecting upwardly from the backing member 3. A relatively thick layer 9 of infilled particulate material is provided on the backing member 3 supporting the ribbons 7 in a relatively upright position on the backing member 3.

Figure 2:
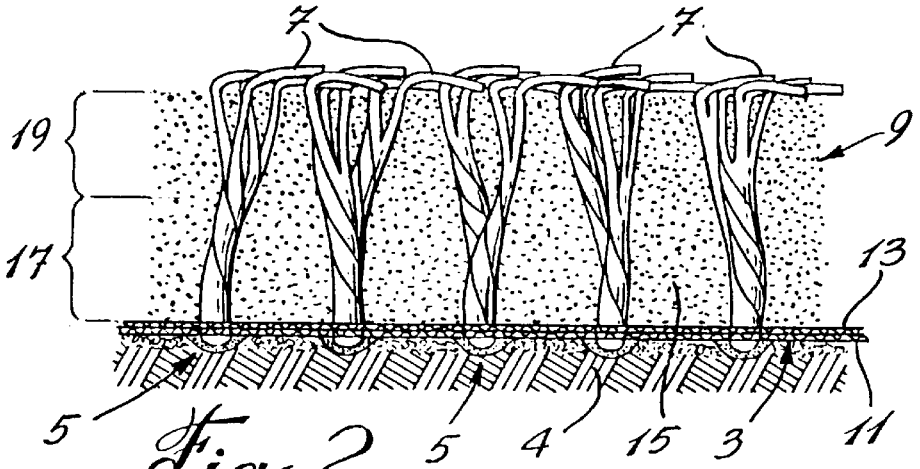
FIG. 2 is a view similar to FIG. 1, showing the free ribbon ends in a natural lying down position.

The flexible, backing member 3 can, as shown, comprise two backing layers 11, 13. The bottom layer 11 can be a woven or needle punched polypropylene fabric. The top layer 13 can also be a woven or needle punched polypropylene fabric. The plastic strips or ribbons 7 are tufted through the backing member 3 as shown in FIG. 2, passing through both layers.

While the backing member 3 has been shown as comprising two layers, it can also be formed from one layer or more. One or more of the layers in the backing member 3 can be a needle punched woven fabric to provide better drainage, the fabric being relatively thick if used only as a single layer. At least one of the layers 11 in the backing member 3 can be needle punched with synthetic, fuzzy fibers (flw) 15, as shown in FIG. 2, to provide means to wick moisture through the layer. The fuzzy fibers further improve drainage of the surface.

The ribbons 7 are made from suitable synthetic plastic material which is extruded in a strip that is relatively wide and thin. The preferred plastic material is polyethylene which is soft and has good abrasion resistance. However, polypropylene can also be used in making the ribbons. The strip can have a width ranging between one-quarter inch and one inch but is preferably around one-half inch wide. The thickness of the strip ranges between 65 microns and 150 microns. The ribbons 7 are cut from the extruded strip and fastened by tufting in the backing member 3 in parallel rows 5. Between 2 to 8 tufts are formed per inch of row with 4 tufts per inch being preferable. The strips are mechanically fibrillated or split to approximately one-eighth of an inch or more.

The fibrillation, which is done mechanically during the manufacturing of the strip, provides a ribbon which resembles a hair net, that is, the resulting fibers are interconnected.

The spacing of the rows of ribbons is dependent on the activity to be performed on the field. For instance, cleats worn on the shoes of athletes for different sports have a spacing on the average of about three-quarters of an inch. Football cleats or soccer cleats may be wider than baseball cleats. The spacing is in relation to the type of sport to be played on the field and is a consequence of the spacing of the cleats on the shoes of the players. Likewise, in sports such as horse racing, it is contemplated that much wider spacing will be required between the rows to accommodate the wider hooves of the horses. Thus, it is contemplated that for horse racing, a spacing between the rows of up to 2¼ inches would be necessary with a proportionally longer ribbon of up to 5 inches.

Relatively wide ribbons, at least one-half inch wide, are preferred because the wider ribbons do not curl as easily as narrower ribbons and resist wear and abrasion better. The wider ribbons 7 also cover more of the particulate material when they lie over, trapping the infill material as shown in FIG. 2. At least the free ends of the ribbons 7, above the particulate material layer 9, are fibrillated to provide a denser appearing pile. Once the synthetic grass has been installed and the infill has been placed, the ends of the ribbons can be further fibrillated by using a steel brush or other mechanical fibrillating means.

It is also contemplated to mix the ribbons in terms of their thickness. For instance, depending on the type of field required, i.e., a field where the ball will roll more slowly than others, stiffer and softer ribbons could be mixed. Stiffer ribbons would tend to have more memory and, therefore, return the ribbons back to an upright position, relatively speaking. Examples of such a mix would be a thick ribbon having a 11,000 denier with possibly 100 to 120 micron thickness. A softer ribbon would have from 5,700 denier and an 80 micron thickness. Any combination of these more rigid and softer ribbons would be determined by the particular requirements of the playing field. The ratio of stiff to soft ribbons may be 1:1. These stiff and soft ribbons may be alternating or part of the same tuft.

In accordance with the present invention, the rows 5 of ribbons 7 are spaced apart a distance "A" that ranges between five-eighths and two and one-quarter inches apart. The row spacing depends on the end use of the surface, a smaller spacing being used for a surface that is used for less physical activity, such as a golf green for example, and a larger spacing being used where more physical activity is encountered, such as a race track for horses, for example.

The relatively wide spacing between the rows of ribbons has several advantages. The wide spacing reduces the tendency of the surface to compact. If the tendency to compact is reduced, drainage of the surface is improved. The wide spacing also reduces the amount of material required for the ribbons. The wide spacing further enhances the playing qualities of the surface. A player playing on the surface is able to obtain better traction because the player's cleats are better able to dig into the particulate material between the ribbon rows. At the same time, the cleats release better because there is more room between the rows to move the particulate material during release. The wide spacing also makes it easier to loosen, clean, and even replace the particulate material. There is room between the rows to insert an air wand into the material to gently loosen it and raise it up slightly. The loosened, raised material can be collected, cleaned of dirt and debris, and returned onto the backing member. The life of the surface is extended and thus replacement costs are reduced. The wide spacing also makes it easier to sew adjacent surface sections together without creating bulky seams since more space is provided for the seam.

The length of the ribbons is also an important feature of the invention. The length "L" of the ribbons 7, that is, the distance from the backing member 3 to the their free ends 17, is at least twice the spacing "A" between the rows 5 of ribbons and preferably between three and six times the spacing "A". The length "L" of the ribbons ranges between three-quarters of an inch and five inches, with the shorter ribbons being used with the surface having the smaller row spacing and the larger ribbons being used with the larger row spacing. The relatively longer ribbons, as compared with those used in the prior art, allow for the use of a thicker infill layer 9, thus providing a more resilient surface without requiring an underpad. The expense of an underpad and the cost involved in installing it is thus eliminated. A thicker infill layer 9 promotes better drainage by creating a higher level of water, thereby creating a higher pressure head from water on the top of the surface. The longer ribbons can also provide more free ribbon above the infill even if the infill is thicker, the free ribbon providing more protection from the sand and other particulate material for players falling on the surface and minimizing abrasion. The ribbons can project anywhere from one-quarter inch to one inch above the infill. The thickness of the infill layer can range between one and four inches depending on the end use of the surface. The layer generally has a thickness "T" of about two-thirds the length "L" of the ribbons.

The layer 9 of particulate material preferably comprises a mixture of a hard sand, such as silica, and cryogenically ground crumb rubber. Cryogenically ground crumb rubber is preferred because the particles are rounder, minimizing abrasion and also lessening compaction. The less angular rubber particles also wet easier thereby aiding drainage. Further, the particles are also less likely to float away if the surface is flooded since microscopic air bubbles are not as readily adhered to the rounded particles. The particles can range in size between four mesh and seventy mesh, but preferably are between fifteen and thirty mesh for sports where abrasion of the players contacting the surface is a factor and between four and thirty mesh where abrasion is not a factor. The silica sand could be replaced by graded small rocks, hard and heavy granulated plastics, or other hard sand. The cryogenically ground crumb rubber could be replaced by other resilient materials, such as cork, styrene, epdm rubber, neoprene, or other similar materials, if the particulate shape equates the shape of cryogenically ground rubber. In some cases, some or all of the resilient material could be replaced by other materials which perform specific roles. An example would be using perlite to replace the resilient material so as to reduce compaction and possibly absorb moisture.

The mix of sand and resilient material can vary depending on the end use of the surface. More rubber is used if the surface requires more resiliency. In relatively thick surfaces the layer 9 of particulate material can be divided in sub-layers with the lower sub-layer 17 adjacent the backing member 3, as shown in FIG. 2, having smaller particles and the upper sub-layer 19 having larger particles to initiate good drainage. The particles in the lower sub-layer 17 could be mainly sand with a mesh size of about forty to seventy mesh. The upper sub-layer 19 would comprise larger particles of sand combined with the rubber particles. Using mainly, or only, sand in the lower layer reduces the cost of the surface.

The surface 1 is manufactured by attaching the ribbons 7 by tufting them through the backing member 3 in rows 5 that are spaced between five-eighths and two and one-half inches apart, there being 2 to 8 ribbons per inch in each row. Once the ribbons 7 are tufted in place, the backing member 3 can be coated on its back side to adhere the ribbons to the backing member. The entire backing member can be coated.

Figure 3:
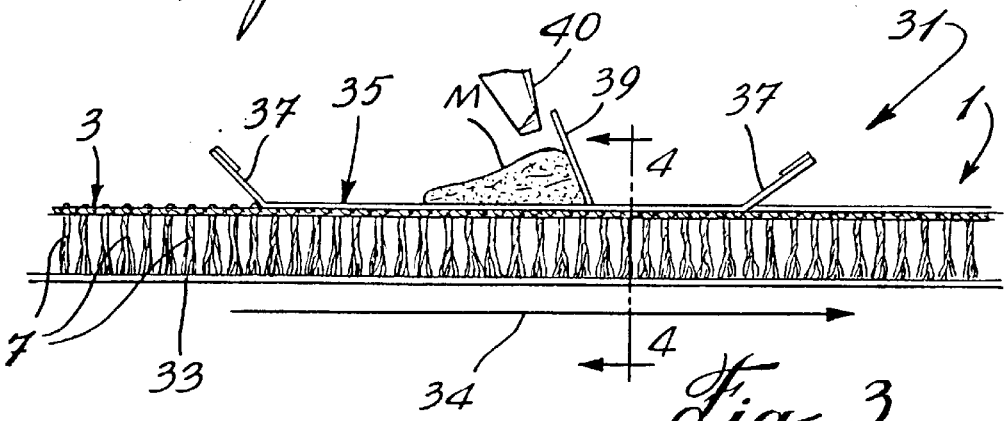
FIG. 3 is a side view of the coating machine.
Figure 4:
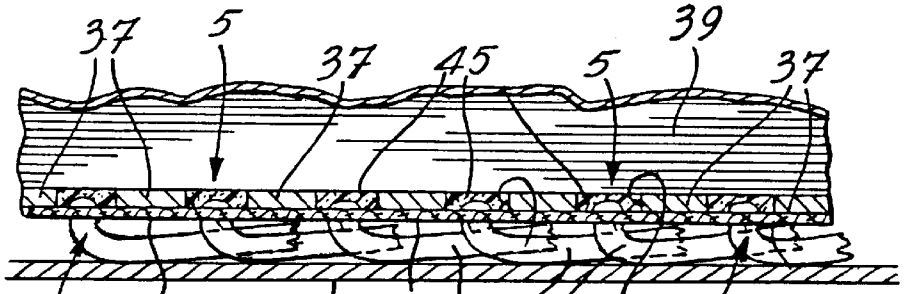
FIG. 4 is a cross-section view taken along line 4—4 in FIG. 3.
Figure 5:
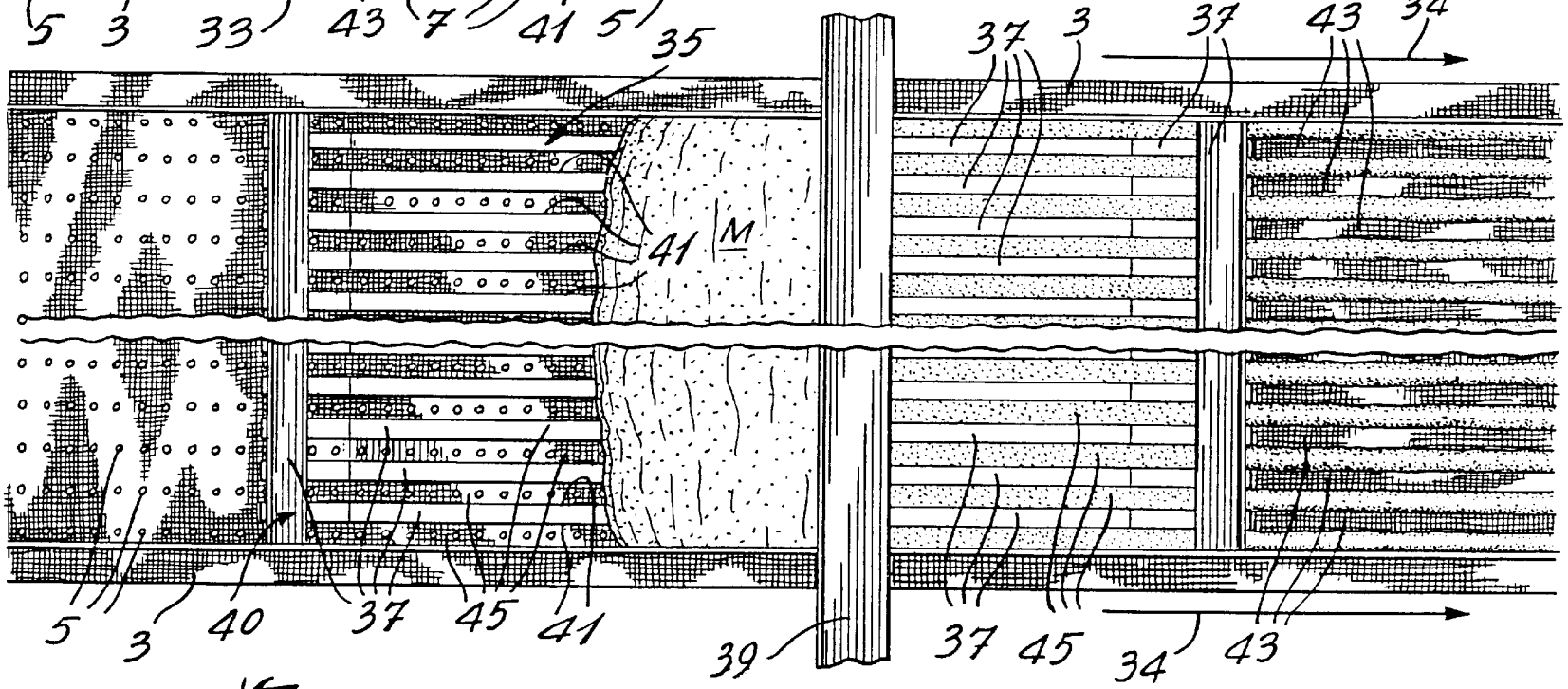
FIG. 5 is a top view of the machine.
Figure 6:
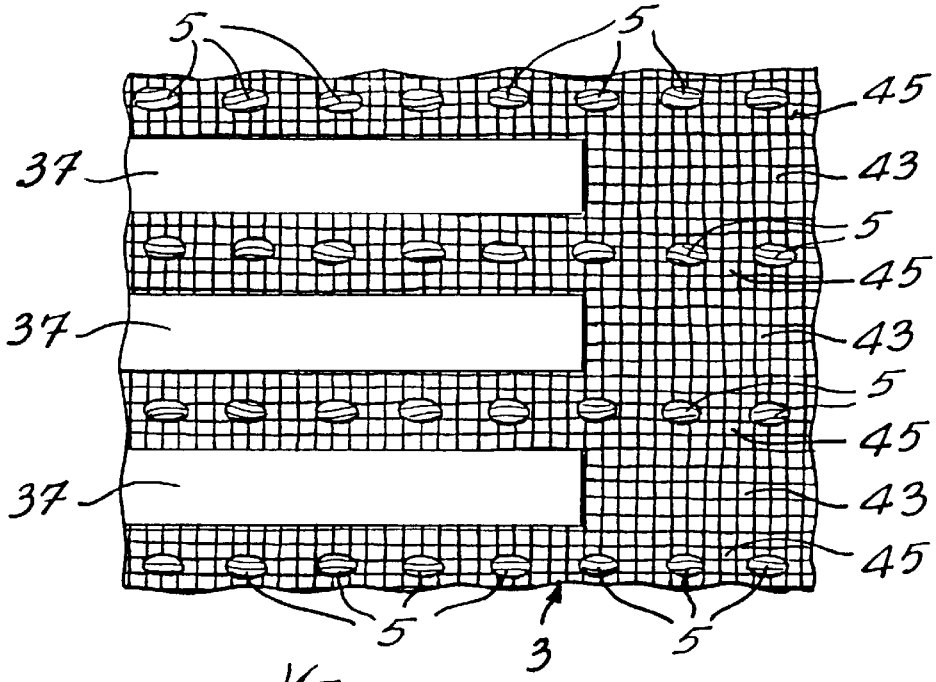
FIG. 6 is a detail top view.
Figure 7:
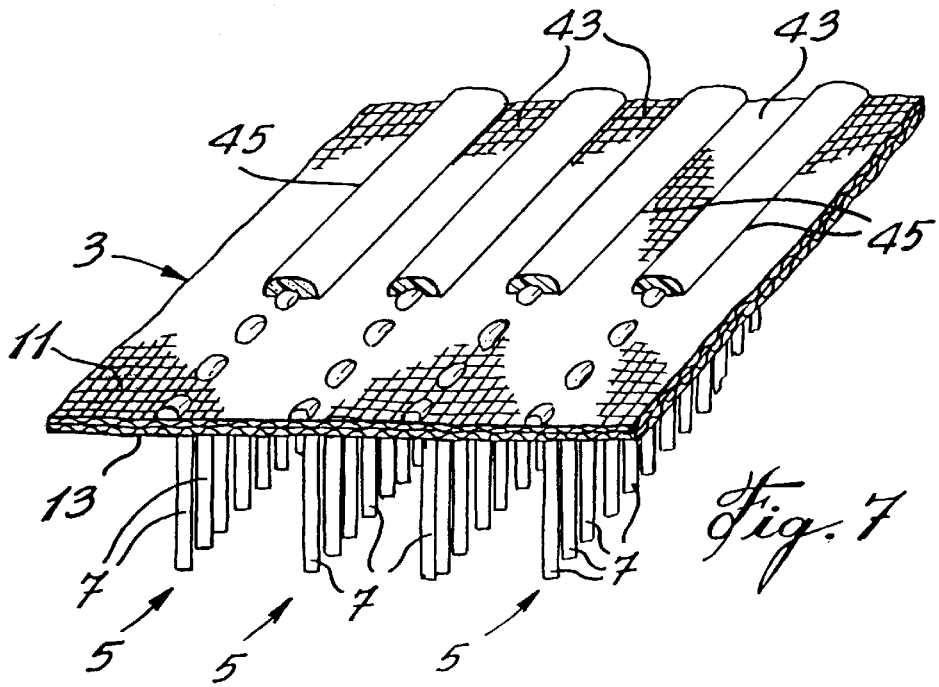
FIG. 7 is a perspective view of the backing member after it has been coated.

Preferably, however, in one embodiment of this invention, using a porous backing member, only portions of the backing member are coated to provide better drainage and to reduce costs. In accordance with this embodiment, the backing member 3, after the ribbons 7 have tufted in place, is passed, upside down, through any standard carpet coating machine. The coating machine 31, as shown schematically in FIGS. 3, 4, 5 and 6, has a support plate 33 to support the tufted backing member 3 of the surface 1 as it is being passed through the machine. Means, not shown, are provided for moving the member 3 across the support plate 33 from one side to the other, as shown by the arrow 34 in FIG. 3. As the member 3 moves across the support plate 33, it passes under a comb-like device 35 having an array of parallel fingers 37 which rest on top of the bottom of the backing member 3, against the support plate 33. The fingers 37 are adjustable as to the spacing between them, and are adjusted to place one finger between each pair of adjacent rows 5 of ribbon on the backing member 3. A doctor blade 39 is located above the fingers 37 nearer the front of the fingers 37 than their back. Applicator means 40 are provided for applying coating material "M" onto the comb-like device 35, across its width, just in front of the doctor blade 39. As the member 3 is moved to the right, as shown in FIG. 3, under the device 35, the coating material "M" is carried with it to the doctor blade 39 where it is spread and laid down against the narrow areas 41 of the backing member 3 that are not covered by the fingers 37. These areas 41 contain the ribbon rows 5, and the ribbon ends in these rows are covered with the coating material "M" to adhere the ribbons 7 to the backing member 3. The fingers 37 prevent coating material "M" from covering the narrow areas 43 of the backing member 3 adjacent the ribbon rows 5. As the member 3 moves away from under the fingers 37, the back of the member 3, as shown in FIG. 7, has strips 45 of coating material "M" covering the ribbon rows 5, but adjacent areas 43 of backing member 3 are uncovered, because of the fingers, to provide a very porous surface which easily drains. The coating applied by the coating machine is much less in quantity than that required to coat the entire backing member, and thus additional savings in material are provided making the surface less expensive.

While one form of applying the coating in strips on the rows of ribbons has been described, the coating could be applied by other means. For example, a series of nozzles could apply thin lines of coatings onto the rows of ribbons and a doctor blade could flatten the lines of coating onto the back of the mat while leaving relative wide, elongated areas of the backing member uncoated and thus capable of fast drainage. Coating rolls of different diameters could also be used to apply the coating.

Figure 8:
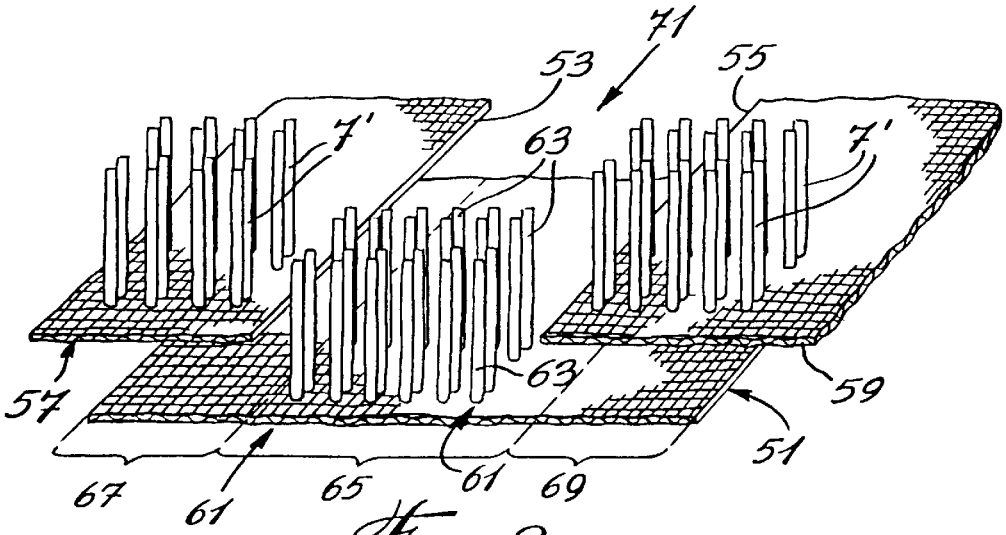
FIG. 8 is an exploded, end view of a seam in the surface, the seam forming a marking line.
Figure 9:
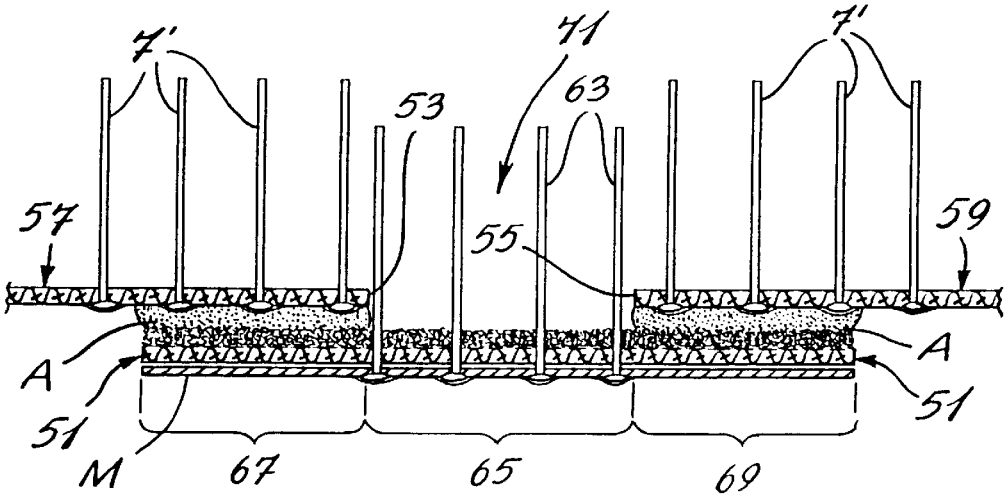
FIG. 9 is an assembled view of the seam of FIG. 8.

In accordance with another embodiment of the invention, lines for marking out a playing area can be formed in the surface by joining the adjacent edges of surface sections with a specific seam. As shown in FIG. 8, a seam band 51 is placed under the adjoining but spaced-apart edges 53, 55 of adjacent surface sections 57, 59 respectively to be joined. The seam band 51 has rows 61 of tufted ribbons 63 in its central section 65 but no ribbons on its wide side sections 67, 69. The central section 65 is located between the edges 53, 55 of the surface sections 57, 59, and the tufted ribbons 63 in the central section 65 can have a different colour and/or a different height from the ribbons 7' in the surface sections 57, 59 to form a line 71 for marking a playing field. The wide side sections 67, 69 of the seam band 51 can be needle punched to form fuzzy fabric. Adhesive "A" is applied on top of the wide side sections 67, 69 to adhere the overlapping surface sections 57, 59 to it. The fuzzy fabric enhances the joining of the seam band 51 to the surface sections 57, 59 by the adhesive. The seam band 51 can be coated on its back with coating material "M" just under the central section 65 but preferably under the side sections 67, 69 as well. This prevents the adhesive "A" used in the seam from bleeding through the band 51 and perhaps adhering onto the substrate. When the band 51 has been attached to the surface sections 57, 59, as shown in FIG. 9, seaming them together, the ribbons 63, because of their different appearance from the ribbons 7' in the surface sections 57, 59, define a playing line 71.

In another embodiment of the invention, the surface could be employed with long ribbons, at least four and one-half inches in length, and the particulate layer could be as thick as the ribbons are long. This surface could be used as a growing surface. The particulate material could employ materials that enhance crop growing, such as material that retains moisture for the plants, and material that allows for strong plant root development. The enhancement materials can form one or more sub-layers in the particulate layer. In some cases, the enhancement materials may have a specific gravity less than water, and having this material in bottom sub-layers under the top layer ensures that it stays in place and is not carried by water. The surface would be particularly useful in areas that are arid. Irrigation pipes could be laid right in the layer of particulate material. The porosity of the backing layer could be designed to retain moisture in the material to promote plant growth. The ribbons would minimize the amount of particulate material that might be blown away in windy areas.

A sports field using a high pile of ribbon, a thick layer of particulate material including cryogenically ground rubber, could be utilized to support the planting of natural grass with the roots of the grass extending in the particulate material.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A synthetic surface having a flexible backing member, parallel rows of synthetic ribbons, representing blades of grass, projecting upwardly from the backing member, the rows of ribbons spaced apart from each other from between ⅝ inch and 2¼ inches, and the length of the ribbons, extending upwardly from the backing member, is at least twice the dimension of the spacing between the rows of ribbons, the surface including a relatively thick layer of particulate material on the backing member supporting the ribbons in a relatively upright position relative to the backing member, wherein the particulate layer has a thickness of substantially two-thirds the length of the ribbons.

2. A surface as claimed in claim 1, wherein the length of the ribbons, extending upwardly from the backing member, is from between 1¼ and 5 inches.

3. A surface as claimed in claim 1, wherein the ribbons extend between ¼ inch and 1 inch above the layer of particulate material.

4. A surface as claimed in claim 1, wherein the ribbon has a width of about one-half of an inch.

5. A surface as claimed in claim 1, wherein the backing member is a single layer of permeable fabric.

6. A surface as claimed in claim 1, wherein the backing member is a double layer of permeable fabric.

7. A surface as claimed in claim 1, wherein the backing member is a triple layer of permeable fabric.

8. A surface as claimed in claim 1, wherein the particulate layer is a mixture of sand and cryogenically ground rubber.

9. A surface as claimed in claim 1 or 8, wherein at least a portion of the particulate material ranges between fifteen to thirty mesh.

10. A surface as claimed in claim 5, 6 or 7, wherein the backing member comprises one or more layers of fabric, at least one of the layers of fabric being needle punched to produce fuzzy fibers on its surface.

11. A surface as claimed in claim 5, wherein the single layer of permeable fabric is needle punched to produce fuzzy fibers on its surface.

12. A synthetic grass surface, wherein the synthetic grass surface comprises a flexible backing member, parallel rows of synthetic ribbons, representing blades of grass, projecting upwardly from the backing member, the rows of ribbons spaced apart from each other, the surface including a relatively thick layer of particulate material on the backing member supporting the ribbons in a relatively upright position relative to the backing member, wherein the relationship of the length of the ribbons and the spacing between the rows is $$2A \leqq L$$

such that the length of the ribbons is at least twice the spacing; and the particulate material having a thickness T of substantially ⅔ the length of the ribbons, when A is the spacing between the rows, L is the length of the ribbon measured from the flexible backing and T is the thickness of the layer of particulate material.

13. The surface as claimed in claim 12, wherein the ribbons extend between ¼ inch and 1½ inches above the layer of particulate material.

14. The surface as claimed in claim 12, wherein each of the ribbons has a width of about ½ inch.

15. The surface as claimed in claim 12, wherein the backing member is a single layer of permeable fabric.

16. The surface as claimed in claim 12, wherein the backing member is a double layer of permeable fabric.

17. The surface as claimed in claim 12, wherein the backing member is a triple layer of permeable fabric.

18. A surface as claimed in claim 15, 16, or 17, wherein the backing member comprises one or more layers of fabric, at least one of the layers of fabric being needle punched to produce fuzzy fibers on its surface in order to increase the permeability of the backing member.

19. The surface as claimed in claim 17, wherein at least one of the layers of permeable fabric is needle punched to produce fuzzy fibers on its surfaces.

20. The surface as defined in claim 12, wherein the dimension A is between ⅝ inch and 2¼ inches, the dimension L is between 1½ and 5 inches.

21. The surface as defined in claim 12, wherein the relationship of the length of the ribbons, the spacing between the rows and the thickness of the particulate material is:

$$2A=3/2T=L.$$

22. The surface as defined in claim 12, wherein L is in a range of between 3A and 6A.

23. The surface as defined in claim 22, wherein A is in the range of ⅝ inch and 2¼ inches; and L is in the range of 1½ inches to 5 inches.

24. A synthetic surface as defined in claim 13, wherein the ribbons extend between ¼ inch and 1 inch above the layer of particulate material.

25. A synthetic surface as defined in claim 12, wherein the particulate layer is a mixture of sand and cryogenically ground rubber.

26. The synthetic surface as defined in claim 1 or 12, wherein the synthetic surface is a surface for a sports playing field.

27. The synthetic surface as defined in claim 12, wherein the synthetic surface is a surface for agricultural crops having a crop growing enhancement material within said particulate material.

28. The synthetic surface as defined in claim 27, wherein said ribbons are at least four and one-half inches in length.

* * * * *

US006723412C1

(12) INTER PARTES REEXAMINATION CERTIFICATE (0155th)

United States Patent

Prévost

(10) Number: US 6,723,412 C1

(45) Certificate Issued: Apr. 20, 2010

(54) SYNTHETIC TURF

(75) Inventor: Jean Prévost, Westmount (CA)

(73) Assignee: Fieldturf (IP) Inc., TMR-Montreal, Quebec (CA)

Reexamination Request:
No. 95/000,096, Jun. 10, 2005

Reexamination Certificate for:

| | |
|---|---|
| Patent No.: | **6,723,412** |
| Issued: | **Apr. 20, 2004** |
| Appl. No.: | **09/988,783** |
| Filed: | **Nov. 20, 2001** |

Related U.S. Application Data

(62) Division of application No. 08/947,881, filed on Oct. 9, 1997, now Pat. No. 6,338,885.

(30) Foreign Application Priority Data

Mar. 10, 1997 (CA) ..... 2199595

(51) Int. Cl.
*E01C 13/08* (2006.01)
*D06N 7/00* (2006.01)

(52) U.S. Cl. ..... 428/87; 428/143; 428/167; 428/220; 428/317.9; 428/327; 428/332; 428/402; 428/95

(58) Field of Classification Search ..... 428/87, 428/17, 95, 327, 143, 167, 220, 319.9, 332, 428/402

See application file for complete search history.

(56) References Cited

U.S. PATENT DOCUMENTS

| | | | | |
|---|---|---|---|---|
| 4,025,990 | A | 5/1977 | Lovette, Jr, | |
| 4,337,283 | A | 6/1982 | Haas, Jr. | |
| 4,396,653 | A | 8/1983 | Tomarin | |
| 4,426,415 | A | 1/1984 | Avery | |
| 4,655,635 | A | 4/1987 | Furukawa | |
| 5,489,317 | A | 2/1996 | Bergevin | |
| 5,850,708 | A | 12/1998 | Bergevin | |
| 6,338,885 | B1 | 1/2002 | Prevost | |
| 6,551,689 | B1 * | 4/2003 | Prevost | 428/143 |

FOREIGN PATENT DOCUMENTS

| | | |
|---|---|---|
| AT | 001 714 U1 | 10/1997 |
| AU | B-41944/93 | 1/1994 |
| CA | 1182484 | 2/1985 |
| CA | 2095158 | 10/1994 |
| IT | 1197180 P | 11/1988 |
| JP | A-S58-7005 | 1/1983 |
| JP | 59-24004 | 2/1984 |
| JP | A-S62-59706 | 3/1987 |

OTHER PUBLICATIONS

Supergrasse Hockey Export Brochure, Supergrasse Pty. Ltd., Australia 1987.

Desso Sportilan Hockey, Australia, 1988.

Evergreen Action Grass Data Sheet, Oct. 1988.

Balsam Pacific Porduct Specification Sheet, Jan. 1995.

"Bowlers Do You Want The Very Best Synthetic Surface," King Heylen Brochure.

Federal Court of Australia Victoria District Registry, *Fieldturf Inc.* v. *Balsam Pacific Pty Ltd, et al.,* Affidavit of Alan John Berry, pp. 1–8, 39, Apr. 2, 2004.

www.sti–sports.com, "POLIGRAS Fieldturf's Australian Patents For Synthetic Turf Revoked," Apr. 2004.

Scrap Tyres Make Profits; Recycling Includes Related Articles On Government's View and on the Competition, European Rubber Journal, 1990 Crain Communications Ltd. (UK).

Praxiar & Recovery Technologies Team On Scrap Tire Grinding, PR Newswire Association, Oct. 27, 1993.

(Continued)

*Primary Examiner*—Stephen J Stein

(57) ABSTRACT

A synthetic grass surface comprising widely spaced rows of ribbons and the ribbons having a length about twice as long as the spacing between the rows of ribbons. A particulate material is laid on a matrix of the synthetic grass, and the thickness of the particulate material is as least two-thirds the length of the ribbons.

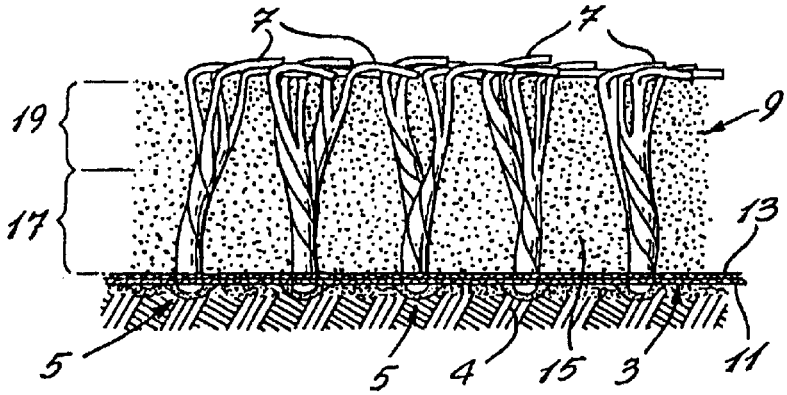

OTHER PUBLICATIONS

United States Court of Appeals For the Fifth Circuit, *Southwest Recreational Industries, Inc.* v *Fieldturf, Inc.,* and Fieldturf International, Inc., Aug. 13, 2002.

"Fieldturf Found Guilty of Lying To Public," AstroPlay What's New News Release, web.archive.org/web, Southwest Recreational Industries, Jan. 23, 2001.

"Fake Grass Coming To Wall Street," CNNMoney Online, Andrew Stein, CNNMoney, Jun. 21, 2004.

"Exciting Future For Fieldturf Is On The Horizon," website www.fieldturf.com/news/pressReleases.cfm?newsID, Steve Saviuk, Sep. 15, 2001.

"Rowdies' Gathering Celebrates Team, Title, Time," St. Petersburg Times Online Sports, Rodney Page, Aug. 4, 2000.

"SynTennico Inc.," Fieldturf web page for Mar. 1997, web.archive.org, www.fieldturf.com.

Millest, Jennifer, "Surface Judgement," Sports & Leisure, Sep./Oct. 1998, pp. 33–34, vol. 29 No. 4.

*In re Malagari,* 499 F.2d 1297, 182 USPQ 549 (CCPA 1974).

Praxair, Inc., *Cryogenic Processing Of Scrap Tires,* American Chemical Society Rubber Division, Oct. 1995 ("the ACS '95 article").

*1998 Best Practices In Scrap Tires & Rubber Recycling, Ambient Versus Cryogenic Grinding,* CWC, 1998 ("the Best Practices article").

*Syntennico, Inc.,* v. *American Sports Products Group, Inc., and Southwest Recreational Industries, Inc.* In–Court Transcripts Jan. 13–15, 1999.

*Syntennico, Inc.,* v. *American Sports Products Group, Inc., and Southwest Recreational Industries, Inc.* Order Denying Preliminary Injunction Motion, Jan. 26, 1999.

EPO Prosecution History of EPO Patent Application No. 98907794.6

Canadian Prosecution of History of Fieldturf's Canada Patent Application No. 2,218,314.

*Specialty Surfaces International, Inc., d/b/a Sprinturf and Henry A. Julicher* v. *Fieldturf International, Inc., Fieldturf, Inc.,* Fieldturf's Markman Brief In Support Of Its Proposed Claim Construction, Jan. 28, 2005 ("Fieldturf's Markman Brief").

*Specialty Surface International, Inc., d/b/a Sprinturf and Henry A. Julicher* v. Fieldturf International, Inc., Fieldturf, Inc., Plantiffs' Brief In Support of Their Claim Construction Arguments, Jan. 28, 2005 ("Sprinturf's Markman Brief").

*In re Kenneth Harris and Jacqueline B. Wahl,* No. 04–1370, 2005 U.S. App. LEXIS 9520 (Fed. Cir. May 25, 2005).

* cited by examiner

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 1–28 is confirmed.

* * * * *